US006024595A

United States Patent [19]

Saba et al.

[11] Patent Number: 6,024,595

[45] Date of Patent: Feb. 15, 2000

[54] CONNECTOR

[75] Inventors: Toshikazu Saba; Hiroki Osawa, both of Yokkaichi, Japan

[73] Assignee: Sumitomo Wiring Systems, Ltd., Yokkaichi, Japan

[21] Appl. No.: 08/899,141

[22] Filed: Jul. 23, 1997

[30] Foreign Application Priority Data

Jul. 23, 1996 [JP] Japan ..... 8-193690

[51] Int. Cl.[7] ..... H01R 3/00

[52] U.S. Cl. ..... 439/489; 439/352

[58] Field of Search ..... 439/350, 352, 439/357, 488, 489, 353

[56] References Cited

U.S. PATENT DOCUMENTS

| | | | |
|---|---|---|---|
| 4,946,395 | 8/1990 | Cope et al. | 439/352 |
| 5,120,255 | 6/1992 | Kouda et al. | 439/489 |
| 5,127,847 | 7/1992 | Kato et al. | 439/489 |
| 5,199,902 | 4/1993 | Kahle et al. | 439/352 |
| 5,234,356 | 8/1993 | Maejima et al. | 439/352 |
| 5,409,395 | 4/1995 | Okada | 439/354 |
| 5,507,666 | 4/1996 | Yamanashi | 439/489 |
| 5,605,471 | 2/1997 | Plyler | 439/489 |
| 5,605,472 | 2/1997 | Sakai et al. | 439/489 |
| 5,613,876 | 3/1997 | Sakatani et al. | 439/552 |
| 5,688,142 | 11/1997 | Dietz et al. | 439/489 |
| 5,720,623 | 2/1998 | Polenick et al. | 439/352 |

FOREIGN PATENT DOCUMENTS

| | | |
|---|---|---|
| 0449239 | 10/1991 | European Pat. Off. . |
| 0717465 | 6/1996 | European Pat. Off. . |
| 19525413 | 1/1996 | Germany . |
| 4-66784 | 6/1992 | Japan . |
| 4-72573 | 6/1992 | Japan . |

*Primary Examiner*—Hien Vu
*Attorney, Agent, or Firm*—Greenblum & Bernstein, P.L.C.

[57] ABSTRACT

A connector includes first and second connector housings which are fitted together. A seesaw or lever-type lock piece is provided in one of said connector housings and a hooking part is provided on the other connector housing for being hooked by a first downward projection of the lock piece. A detecting member is mounted for free sliding movement along the upper face of the lock piece. After a fitting operation of both housings is carried out, the detecting member is pushed forwardly. When the connector housings are in an incomplete fitted position or state, since the first downward projection is mounted on the hooking part and the lock piece is in an oblique position, the pushing of the detecting member is prevented and an incomplete fitted state is detected. When the detecting member is further pushed in, one of the housings is pushed in with the lock piece and is properly fitted. The detecting member is retained just at the position of the front end of the lock piece and the connector housings are thereby double locked.

8 Claims, 10 Drawing Sheets

CONNECTOR

BACKGROUND OF THE INVENTION

1. Field of the Invention

The present invention relates to a connector including first and second housings. A lock piece on one housing cooperates with a hooking part on the other housing. A detecting member indicates whether the housings are properly locked together.

2. Description of Background Information

A connector using the motion of a position change of a lock piece in order to detect partial connection of connector housings has been previously proposed. An example is a lever or seesaw type lock piece having a downward projection on a front side of one connector housing. A hooking part adapted to hook the downward projection is provided on the other connector housing. When both housings are fitted together, the downward projection is mounted on the hooking part and the lock piece is pushed in as it swings about a fulcrum. When both housings are properly fitted, the lock piece returns to its original position and is locked by hooking the downward projection on the hooking part. Furthermore, a detecting member is inserted in the bottom side of a rear end of the lock piece, and when both housings are properly connected together, the lock piece returns to its original position and the detecting member can be inserted into an opening at the bottom side of the rear end part. On the other hand, when both housings are only partially fitted together, the detecting member cannot be inserted because the downward projection is mounted on the hooking part and the lock piece swings. Therefore, it is possible to detect an incomplete connection of the housing.

However, this method has disadvantages. For example, when the lock piece is a seesaw or lever, the rear end hangs down if the downward projection on the front end is mounted on the hooking part, but the lock piece itself, which is a synthetic resin having elasticity, becomes bent and does not change its position to extend downward at the rear end. Although it may slightly change its position depending on its shape when it is mounted on the hooking part, the downward projection is kept in an incomplete fitted position or state and the detecting part is under the rear end of the lock piece so that it cannot be detected. Accordingly, this conventional method has not been reliable.

SUMMARY OF THE INVENTION

The present invention includes a connector having a lock piece which is capable of elastically and obliquely moving in either one of a pair of mutually fitted connector housings. The lock piece is obliquely moved by passing over a hooking part which is provided at an opposite connector housing when the connector housings are fitted together. Both connector housings are locked in a proper fitting position or state by the lock piece which returns to its original position when both connector housings are properly fitted. A detecting member is capable of moving towards a predetermined location in response to oblique movement of an end of the lock piece. The obliquely moving end of the lock piece extends over a portion of the detecting member when the lock piece passes the hooking part.

According to an aspect of the invention, a connector includes first and second connector housings adapted to be connected together along a fitting direction to between a plurality of improperly fitted positions and a properly fitted position. A hooking part is attached to one of the first and second connector housings.

A lock piece is provided on the other of said first and second connector housings and includes an end portion for obliquely moving and passing over the hooking part and being adapted to return to its original position to hook the hooking part when the first and second connector housings are in the properly fitted position. A detecting member is movable along the fitting direction and is offset from the position of the end portion of the lock piece, as viewed along the fitting direction, when the first and second connector housings are in the improperly fitted position.

The detecting member extends over the end portion of the lock piece when the first and second connector housings are in the properly fitted position. The end portion of the lock piece and the detecting member are not offset from each other, as viewed along the fitting direction, when the first and second connector housings are in the properly fitted position.

The detecting member includes a pushing member for pushing the other of the first and second connector housings into the properly fitted position from the improperly fitted positions in order to double lock the first and second connector housings together.

The detecting member moves in a backward and forward direction along the fitting direction of the connector housings and pushes the lock piece in by a predetermined force when the detecting member extends over the lock piece.

According to another aspect of the invention, an element keeps the detecting member at the outside of the end portion of the lock piece.

According to another aspect of the invention, the end portion of the lock piece includes a first downward projection having a first contact face. The hooking part includes a second contact face, and the first contact face initially contacts the second contact face and thereafter passes over the hooking part when the first and second connector housings are moved to the properly fitted state. The second contact face may be inclined.

The lock piece may include a lever that swings about a fulcrum on the other of the first and second housing. The detecting member includes at least one projection. A second downward projection is provided on the other of the first and second housings. The at least one projection engages the second downward projection when the first and second connector housings are moved to the properly fitted state to thereby double-lock the first and second connector housings together.

According to another aspect of the invention, the connector includes first and second connector housings being adapted to be connected together along a fitting direction between a plurality of improperly fitted positions and a properly fitted position. A lock piece is obliquely movable in one of the first and second connector housings. A hooking part is provided on the other of the first and second housings. The lock piece moves and passes over the hooking part when the first and second connector housings are fitted together. The first and second connector housings are locked in the properly fitted state by the lock piece and hooking part when the connector housings are properly fitted.

A detecting member moves along the lock piece and a protruding part of the detecting member is provided at a location cooperating with an outside of an obliquely moving end of the lock piece. The protruding part extends over a portion of the detecting member when the detecting member moves along the lock piece. The protruding part is offset from the end of the lock piece, as viewed along the fitting direction, when the first and second connector housings are in the improperly fitted position. The end of the lock piece and the protruding member are not offset from each other, as viewed along the fitting direction, when the first and second connector housings are in the properly fitted position.

When the connector housings are in the incompletely fitted position, the detecting member extends over a protruding part by moving the detecting member along the lock piece. The incompletely fitted state is thereby detected. When the detecting member is further pushed in after protruding from the protruding part, one connector housing is pushed in the other connector housing and they are properly fitted together.

When the lock piece passes over the hooking part, the protruding part is at an outside of the obliquely moving end of the lock piece. Therefore, the detection of the incomplete fitting state can be assured. Further, after the incompletely fitted state is detected, the proper fitting can be automatically obtained by successively pushing in the detecting member. When the detecting member is pushed in, a "double-lock" is obtained.

BRIEF DESCRIPTION OF THE DRAWINGS

The present invention is further explained in the description which follows with reference to the drawings, illustrating, by way of non-limiting examples, various embodiments of the invention, with like reference numbers representing similar parts, and wherein.

DETAILED DESCRIPTION OF THE PREFERRED EMBODIMENTS

Figure 1:
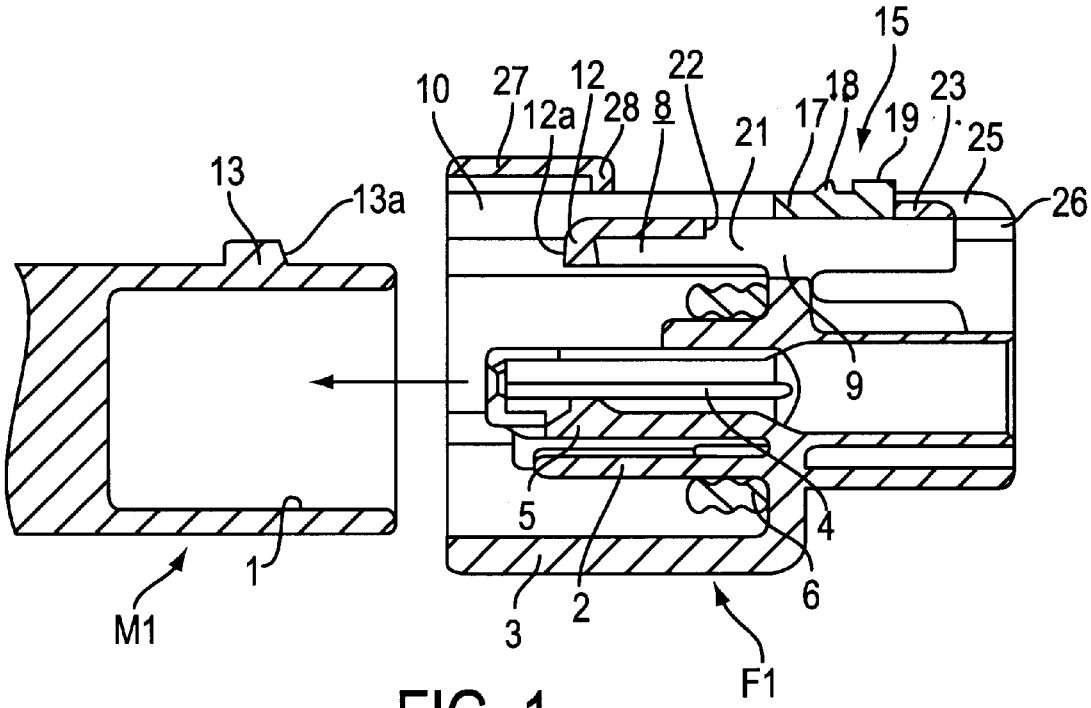
FIG. 1 is a cross sectional view of the connector housings before fitting of the housings according to a first embodiment of the present invention.
Figure 2:
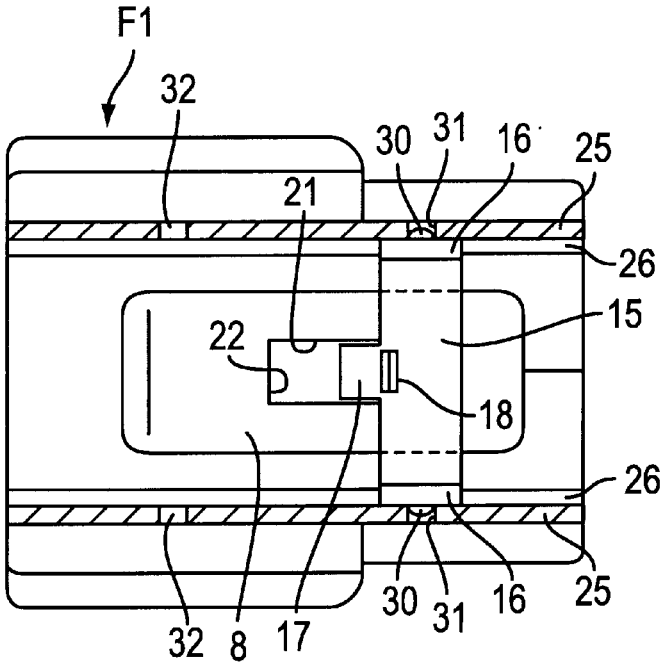
FIG. 2 is a plan view in partial cross section of the female housing.
Figure 3:
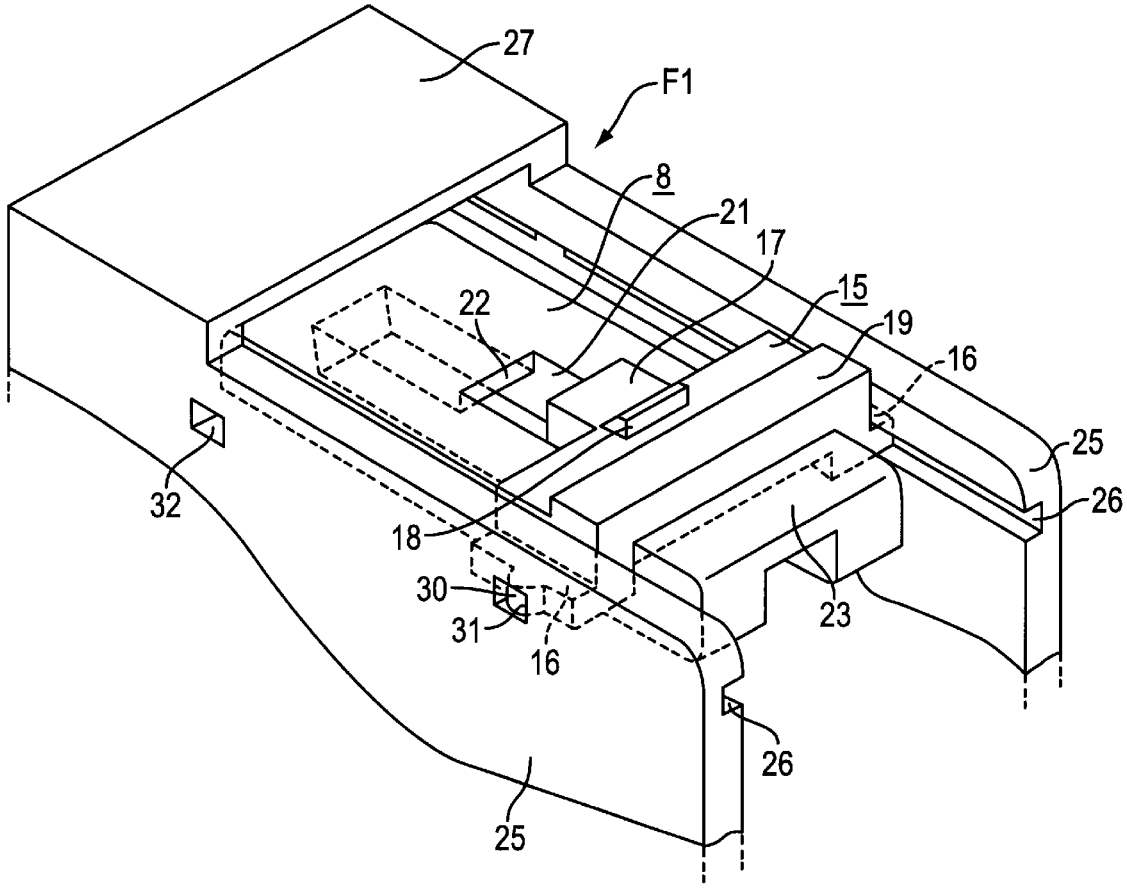
FIG. 3 is a perspective view showing the structure equipped with the detecting member.

The first embodiment of the present invention is illustrated in FIGS. 1–5. The connector of the invention of FIGS. 1–5 is a waterproof and "momentum-lock" type connector. As illustrated in FIG. 1., male housing Me and female connector housing F1 are adapted to be mutually fitted together. Male housing Me is formed from a synthetic resin and is connected to, for example, an engine accessory or the like. Male housing M1 has a rectangular shape having a bottom and an open front face. A plurality of male terminal fittings (not shown) are arranged in and protrude from inner concave part 1.

Female connector housing F1 is similarly formed from a synthetic resin material. A hood 3 is rectangular in shape and is formed around a front end (left side of FIG. 1) of main body part 2. Male housing M1 is fitted in the inside of hood 3 and a front end of body part 2. A plurality of cavities 4 are arranged in body part 2 and are formed to correspond to the male terminal fittings of male housing M1. Female terminals are fixed at the end of wires (not illustrated) and are inserted from the rear face side thereof, and are hooked by a lance 5 provided in cavities 4 to hold such female terminals in a hooked state. Furthermore, waterproof rubber stoppers are fixed to the rear side of the respective female terminals and the inlets of respective cavities are thereby sealed. A rubber ring 6 is provided around body part 2 in the inner portion of hood 3. Both housings M1 and F1 are thereby connected together and a gap between both housings is designed to be sealed by holding the rubber ring 6 between the surrounding wall.

In the gap between both housings M1 and F1, a lock mechanism is provided for locking the housings in a proper fitted state. Lock piece 8 is provided at the center portion in the width direction in the upper face of female housing F1. Lock piece 8 is long and narrow in a longitudinal direction. The lower edges of the left and right side walls at approximately the central portion in the longitudinal direction are integrally connected with body part 2 at fulcrum 9, so that lock piece 8 can swing as a lever or seesaw about fulcrum 9. Furthermore, in an upper face of hood 3, a notch groove 10 opens at a central portion in the width direction to receive the front end of lock piece 8. A first downward projection 12 is formed at a front end of lock piece 8. Front contact face 12*a* of downward projection 12 cooperates with hooking part 13, which is formed at an upper face of male housing M1, as described below. Hooking part 13 is capable of cooperating with and hooking downward projection 12 of the lock piece. Hooking part 13 includes a substantially vertical face at a front end thereof. Hooking part 13 also includes a contact face which is inclined at 13*a*. Therefore, when female housing F1 is pushed into the male housing, first downward projection 12 of lock piece 8 rides over the inclined face 13*a* and lock piece 8 swings in a clockwise direction (see FIG. 4). When both housings M1 and F1 are properly fitted, first downward projection 12 rides over hooking part 13 and therefore the lock piece 8 is restored to its original position and is locked by hooking downward projection 12 on the rear face of hooking part 13 (see FIG. 5).

When contact faces 12*a* and 13*a* of first downward projection 12 and hooking part 13, respectively, are formed in the shape described above, a large force is required to move downward projection 12 over hooking part 13. Therefore, a "momentum-lock" is formed so that if a peak force required for allowing downward projection 12 to ride over hooking part 13 is set to be larger than a peak frictional force at the mutual fitted state of the male and female terminal housings, the female housing F1 is pushed to a proper fitted position by momentum, by pushing the female housing in and letting the downward projection 12 of the lock piece ride over the hooking part 13. The male and female terminal fittings are thereby mutually connected, and both housings M1 and F1 are mutually locked together.

Figure 4:
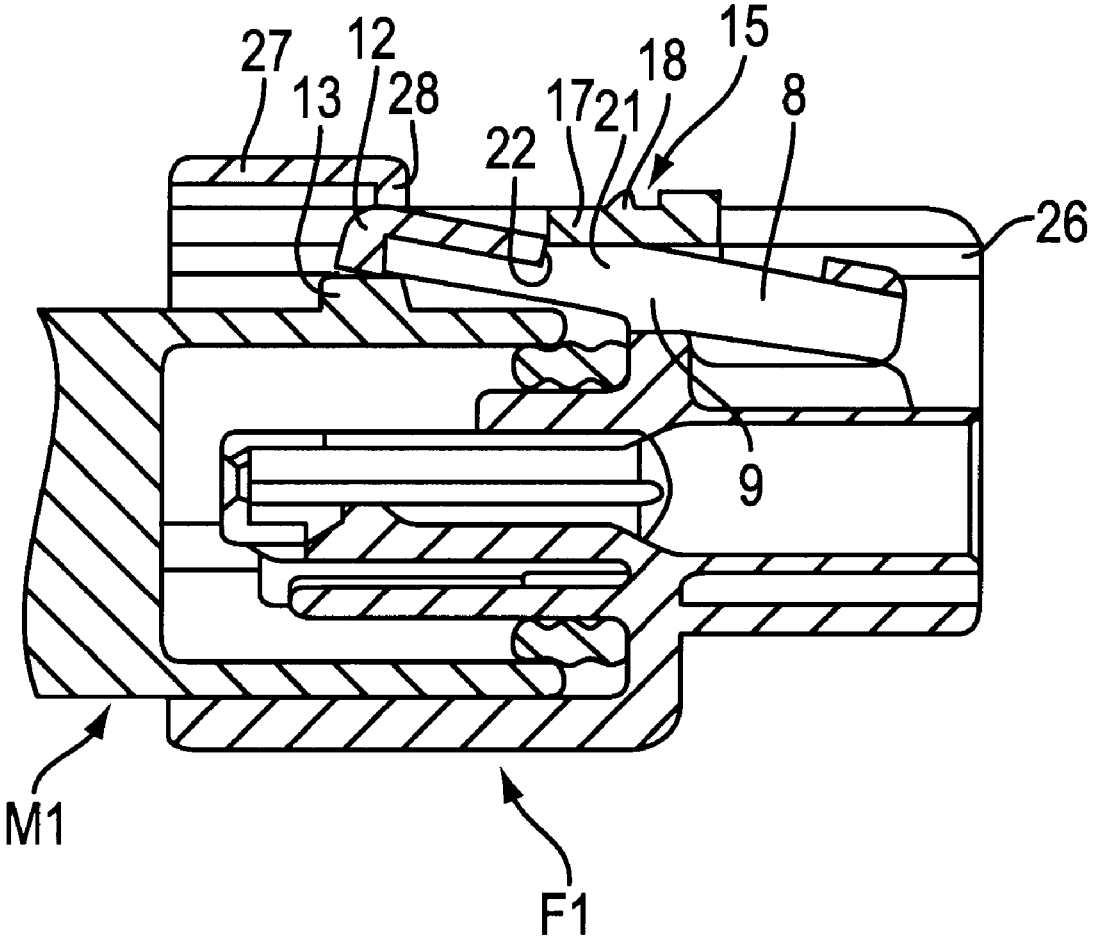
FIG. 4 is a cross sectional view showing the state of detecting the incomplete fitting of the housings.

When the momentum lock is applied as described above, there is little fear that both housings M1 and F1 are in the incomplete fitted state. However, for example, when the female housing F1 is pushed so that lock piece 8 is moved in an unlocking direction before locking, the housings may be kept in the incomplete fitted state with first downward projection 12 of lock piece 8 being on top of hooking part 13 as shown in FIG. 4.

In order to detect this incomplete fitted state, a detecting member 15 is provided in female housing F1. Detecting member 15 is formed as a separate synthetic resin material piece. As shown in detail in FIG. 3, detecting member 15 is formed in an inverted U-shape and crosses over lock piece 8. Legs 16 are formed to protrude to the outside at the lower end of the left and right side faces of detecting member 15. Pressuring part 17 is a predetermined width and protrudes at a central portion in the width direction at the front edge of detecting member 15. Projection 18 is formed at an upper face of an outside edge of pressuring part 17 for hooking (as described below) and an operation part 19 extends upwardly at a rear side of detecting member 15 at a predetermined distance from projection 18.

Groove 21 is formed in an upper face of lock piece 8 and is about the same width as the pressuring part 17 of detecting member 15. This groove extends from a position slightly to the front end from the central portion in the longitudinal direction to the rear end. The front edge of groove 21 acts as a pressure part 22. Pressuring operation element 23 is formed at the upper face of the rear end of lock piece 8 and is slightly higher and extends in the transverse direction.

Female housing F1 includes left and right side walls 25. Guide grooves 26 extend in the longitudinal direction to respectively guide the sliding of both legs 16 of detecting member 15 during the fitting operation.

A roof 27 is slightly higher and is formed at the front ends of both side walls 25. The rear edge of roof 27 is located just at the front edge of lock piece 8. A second downward projection or downwardly projection element 28 is formed at the rear edge of roof 27 and is capable of fitting between the projection 18 of detecting member 15 and the operation part 19.

Convex elements 30 are formed at the outer face of legs 16 of detecting member 15. Rear and front hooking holes 31, 32 on the left and right side walls are capable of receiving convex elements 30. Rear hooking holes 31 are adapted for temporary retention and the front hooking holes 32 are adapted for proper or complete retention.

In particular, detecting member 15 is installed so that legs 16 are inserted from the rear end of the corresponding guide grooves 26 when lock piece 8 is swung in the unlocking direction by pressing pressuring operation part 23, and are temporarily retained by first fitting convex elements 30 into the rear hooking holes 31. At this position, as shown in FIG. 1, the pressuring operation part 23 of lock piece 8 returns to the original position and is designed to be hooked on the rear end of detecting member 15. Furthermore, when detecting member 15 is pushed along guide grooves 26, and reaches the upper position of the front side of lock piece 8, convex elements 30 are thereby retained by being fitted in front hooking holes 32. At the same time, second downward projection 28 of roof 27 can be fitted between projection 18 and operation part 19.

According to the first embodiment as described above, detecting member 15 is retained in advance at the temporary retention position shown in FIG. 1 against female housing F1. After the female terminals are stored in female housing F1, female housing F1 is pushed into male housing M1. Thereafter, while convex elements 30 are removed from rear hooking holes 31, detecting member 15 is pushed forwardly along guide grooves 26.

Thereby, in the fitting operation as described above, both housings M1 and F1 may be initially in an incomplete fitting state without a proper fitting. Then, first downward projection 12 of lock piece 8 swings in the clockwise direction while riding over hooking part 13 as shown in FIG. 4. When detecting member 15 is pushed, pressuring part 17 moves in groove 21 of the upper face of lock piece 8 and protrudes over or abuts the front pressure part 22 so that the incomplete fitting is thereby detected as shown in FIG. 4.

Figure 5:
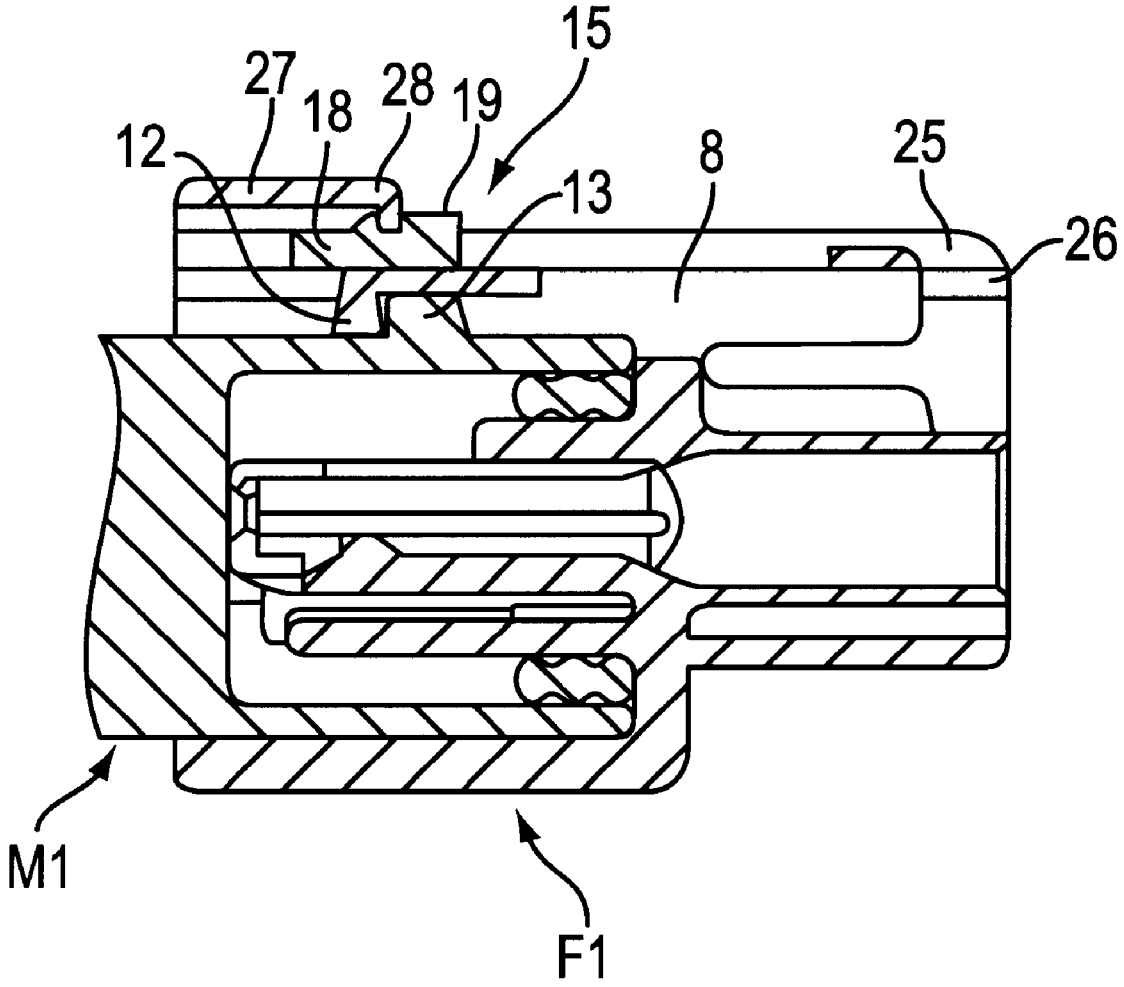
FIG. 5 is a cross sectional view of the state where both housings are properly fitted and a detecting member is retained at the proper retaining position.

Thereafter, when detecting member 15 is further pushed in from the position shown in FIG. 4, lock piece 8 along with female housing F1 is pushed in by detecting member 15 pressing pressured part 22. When female housing F1 is pushed into the proper position, both housings M1 and F1 are locked by hooking downward projection 12 on the rear face of hooking part 13, while lock piece 8 returns to its original position. Detecting member 15 is further continuously pushed in so that the second downward projection 28 of roof 27 fits between projection 18 of detecting member 15 and operation part 19 as shown in FIG. 5 when detecting member 15 is pushed into the predetermined position just above the front end of lock piece 8. Furthermore, convex elements 30 of legs 16 fit in the front hooking holes 32 and detecting member 15 is retained just at the position above the front end of lock piece 8 so that unexpected raising of the front end of lock piece 8 is prevented and the connector housings are "double-locked".

Furthermore, when both housings M1 and F1 are initially properly fitted, detecting member 15 is guided along guide grooves 26 and moved over the upper face of lock piece 8 which has properly returned to its original position, and detecting member 15 is retained just at the position above the front end of lock piece 8 as described above.

According to the first embodiment as described above, after female housing F1 is fitted on male housing M1, pushing of detecting member 15 then is carried out, and when the housings are in the incomplete fitted state, protrusion of detecting member 15 provides detection of such incomplete fitted state. Furthermore, since detecting member 15 protrudes beyond the front end of the lock piece which has changed its position when the lock piece rides over the hooking part 13, highly reliable detection of the incomplete fitted state can be accomplished.

Furthermore, by pushing detecting member 15 in after detecting such incomplete fitting, female housing F1 is pushed in to the proper position and can be locked. Since detecting member 15 can be retained at the position of the front end of lock piece 8, detecting member 15 can function to double lock the housings.

The second embodiment of the present invention is illustrated in FIGS. 6–10. The second embodiment includes a male housing M2 and a female housing F2 which are mutually connected together. Male housing M2 includes a fitting concave part 41 at a front face and is formed with a rectangular shape having a bottom. A plurality of male terminal fittings are arranged and protrude from the rear face of fitting concave part 41.

Figure 6:
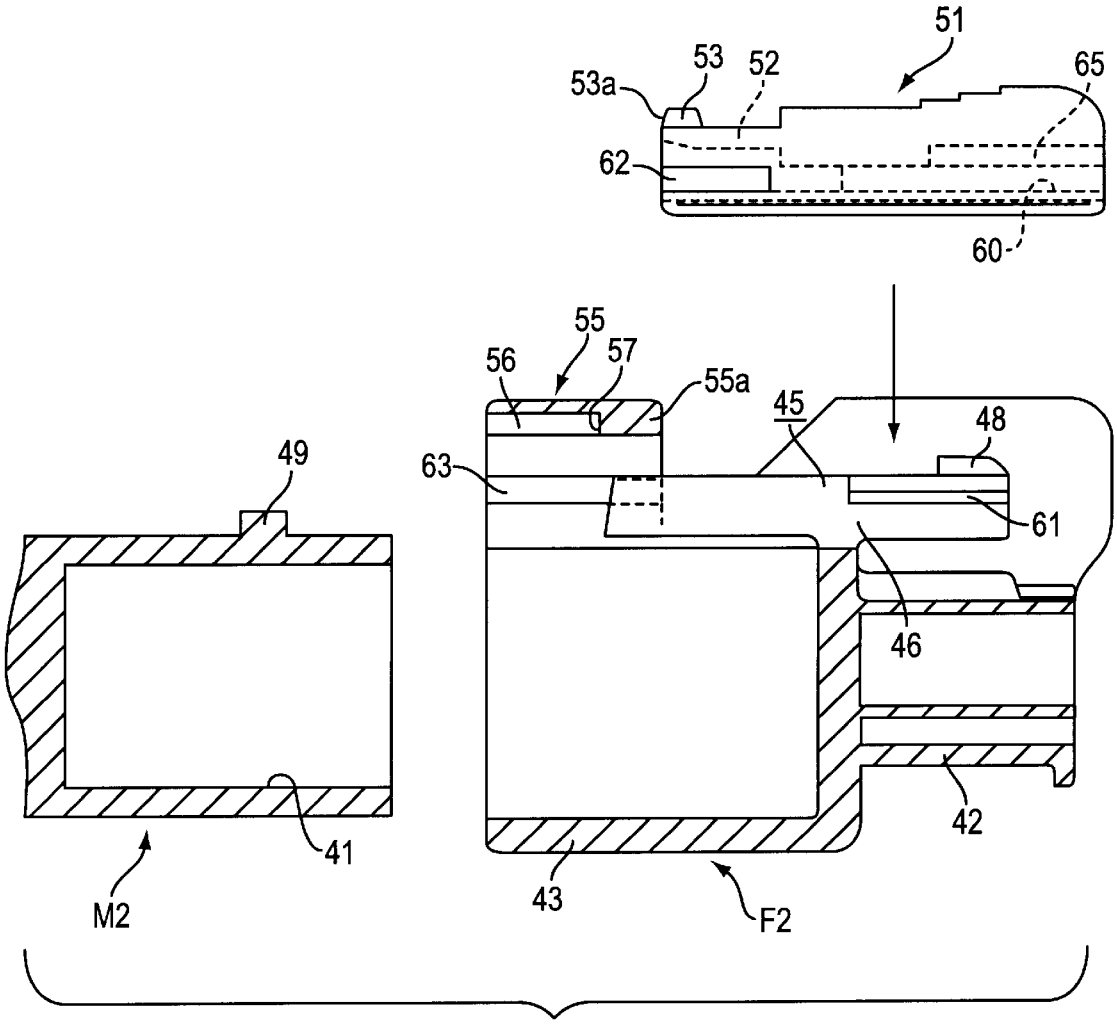
FIG. 6 is a exploded cross sectional view showing a second embodiment of the present invention.

Female housing F2 is schematically illustrated in FIG. 6 and hood 43 is formed to receive male housing M2. Female terminals are stored in body part 42 and are adapted to be connected with corresponding male terminal fittings.

The momentum lock mechanism is provided between housings M2 and F2. Lock piece 45 is provided at the central portion in the width direction on the upper face of female housing F2. Lock piece 45 is long and narrow in the longitudinal direction and is formed in an inverted U-shape. The lower edge of left and right side walls at approximately the center part in the longitudinal direction are integrally connected with body part 42 to form fulcrum 46 so that lock piece 45 can swing in the manner of a lever or seesaw about fulcrum 46. The central portion in the width direction of the upper face of hood 43 is notched to receive the front end of lock piece 45.

A downward projection 47 is formed on the front end of lock piece 45 for hooking on a cooperative hooking part as described below. A step 48 extends upwardly and is formed on the upper face at the rear end of lock piece 45.

A hooking part 49, which is capable of being hooked by downward projection 47 of lock piece 45, is provided on the upper face of male housing M2. The contact face of hooking part 49 and downward projection 47 are substantially vertical, constituting a momentum lock. In particular, when female housing F2 is pushed into male housing M2, downward projection 47 of lock piece 45 passes over hooking part 49 and hooks onto hooking part 49 against a large resistance. Lock piece 45 swings in a clockwise direction (FIG. 9) and after being mounted on hooking part 49, female housing F2 is pushed into the proper position by momentum force. At the time of proper fitting, since downward projection 47 has passed over hooking part 49, lock piece 45 is restored to its original position, and downward projection 47 is hooked at the rear face of hooking part 49 to lock the housings together as illustrated in FIG. 10. Cancellation or disengagement of the lock is possible by applying pressure to the rear end of lock piece 45.

Figure 9:
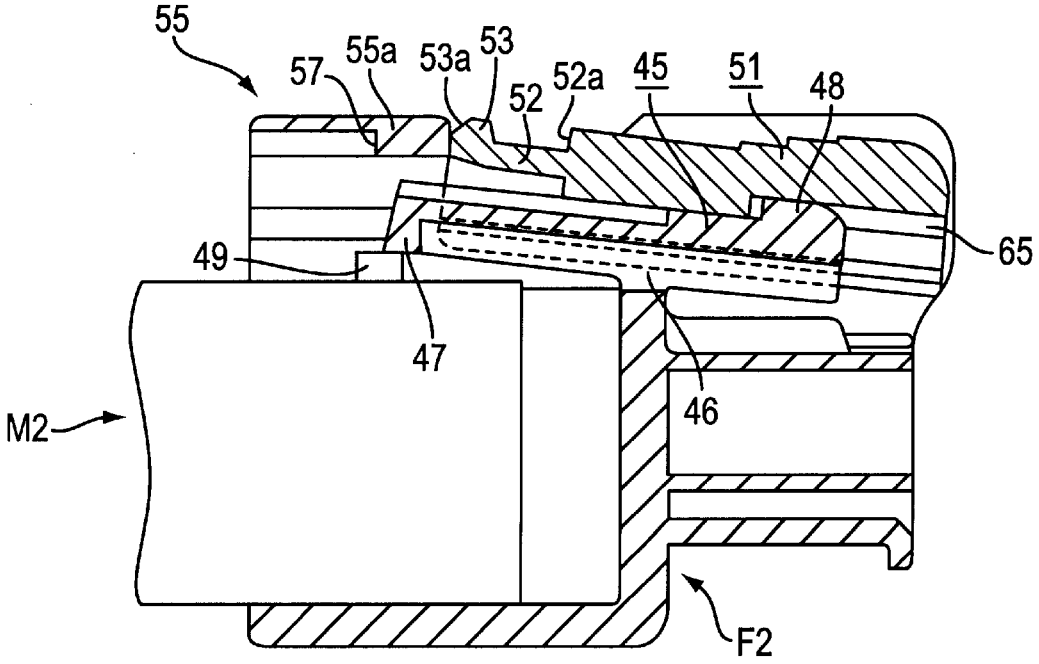
FIG. 9 is a cross sectional view of the state of detecting the incomplete fitting of the housings.
Figure 10:
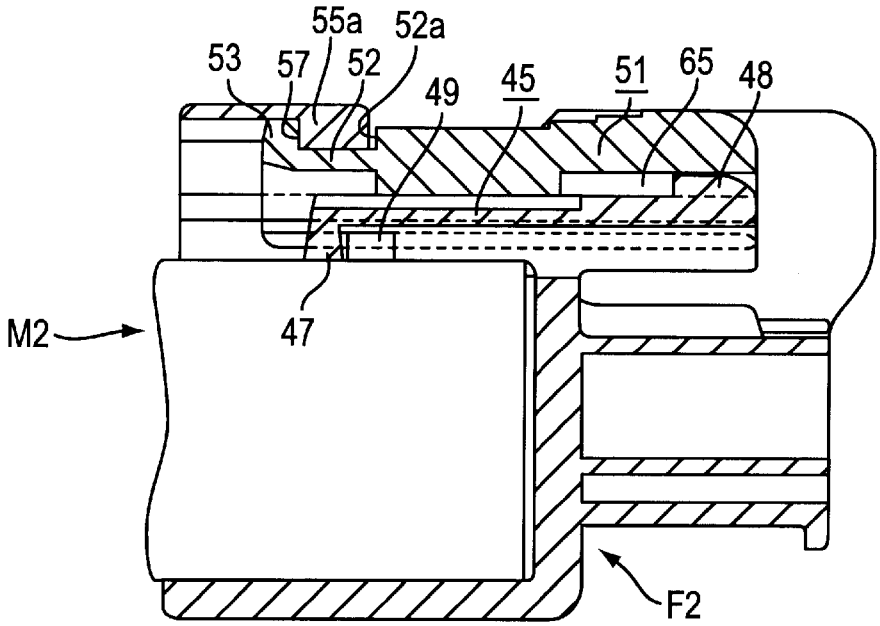
FIG. 10 is a cross sectional view of the state where both housings are properly fitted and the detecting member is retained.

The momentum lock force as described above may be kept in the incomplete fitting state in a like manner as described with respect to the first embodiment, while downward projection 47 of lock piece 45 is positioned on the top face of hooking part 49 as shown in FIG. 9. In order to detect such an incomplete fitting state, detecting member 51 is formed as a separate piece to lock piece 45 of female housing F2. Detecting member 51 has a slightly longer total length than lock piece 45 and is designed to freely slide over the upper face of lock piece 45 in the longitudinal direction. Specifically, a detecting piece 52 having an upward convex part 53 at a tip thereof is provided on the front end of detecting member 51, and is capable of being bent. The front upper end part of convex part 53 has a tapered face 53*a*. A dome 55 is formed on the upper face of hood 43 to cover the front portion from the upper face of the front end of lock piece 45. At an upper face of dome 55, grooves 56 extend from a position which is located at a predetermined distance from the rear end and are open at the front end. The inner portion of grooves 56 includes a hooking part 57 for convex part 53 as illustrated in FIG. 10.

Guide grooves 60 are formed along a longitudinal direction of the inside of left and right legs 59 of detecting member 51. Projecting portions 61 are formed at the right and left side faces of the rear end of lock piece 45 and are fitted in guide grooves 60 for free sliding movement. Projecting elements 62 are formed on the outer face of the front end of both legs 59 and detecting member 51. Guide grooves 63 are formed in the inner face of the left and right side walls of dome 55 for receiving projecting elements 62 for free sliding movement. Guide grooves 65 are formed in an upper inside portion of detecting member 51 in a predetermined position from the rear edge of detecting member 51 where step 48 of lock piece 35 fits.

Figure 7:
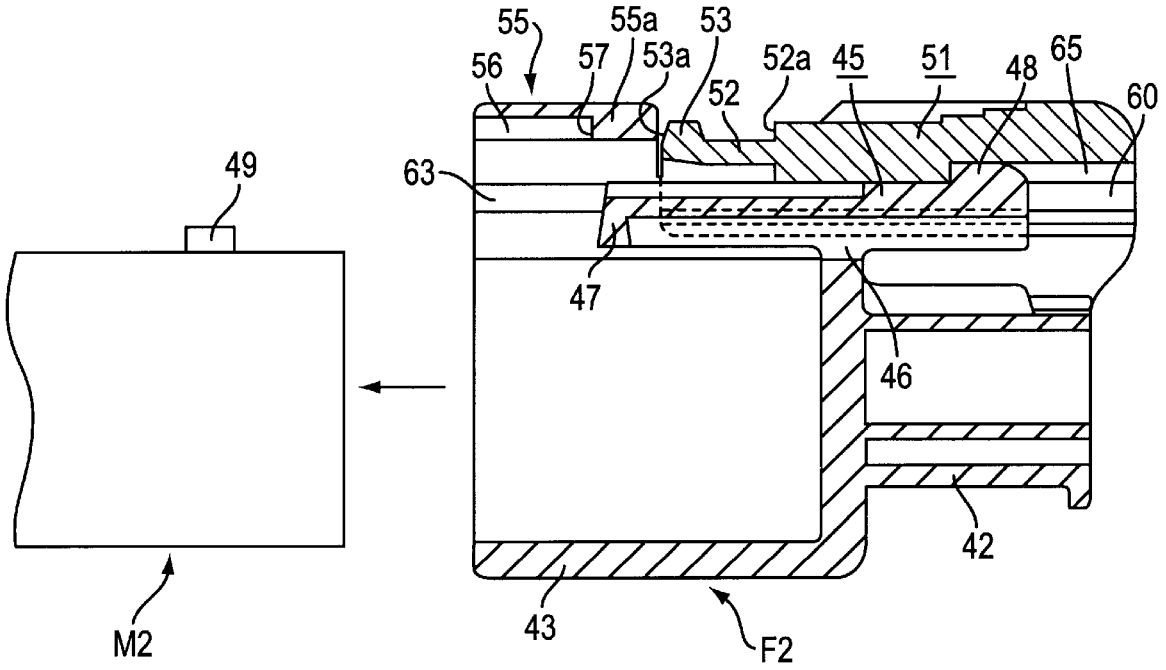
FIG. 7 is a cross sectional view of the state before fitting of the housings.
Figure 8:
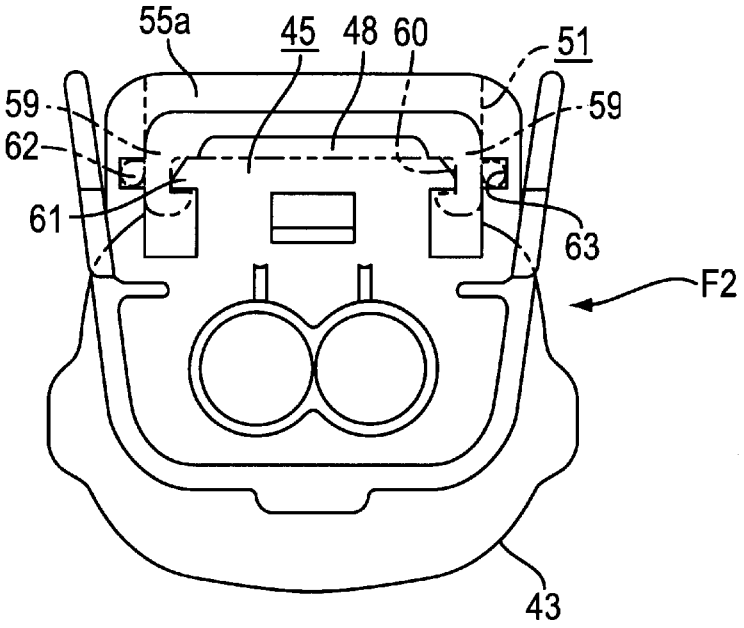
FIG. 8 is a rear view of the female housing.

Detecting member 51 is installed by being pushed in from an upper side as shown by the arrow in FIG. 6. Projecting elements 62 are inserted in the guide grooves 60 while spreading the left and right legs 59. Hooking to the rear side is carried out by placing the inner edge of fitting grooves 65 over step part 48 of lock piece 45 as shown in FIG. 7. This position is a shunting position with a rear end of detecting member 51 protruding by a predetermined amount from the rear end of lock piece 45. Furthermore, the tip of detecting lock piece 52 is located just at the rear side of dome 55 and tapered face 53*a* of convex part 53 is designed to cooperate with the rear edge of ceiling 55*a* of dome 55. Therefore, it is possible for detecting member 51 to be pushed forwardly along lock piece 45 from the shunting position by fitting projecting elements 61 in guide grooves 60 and further fitting projecting elements 61 in guide grooves 63 to be guided thereby. Furthermore, detecting lock piece 52 is bent downwardly by contacting tapered face 53*a* of convex part 53 on ceiling 55*a* of dome 55 and inserting tapered face 53*a* under the lower side of ceiling 55*a* of the dome 55. When detecting member 51 is moved to a predetermined position, detecting piece 52 is restored and deformed to hook convex part 53 on hooking part 57. Furthermore, back and forth motion is regulated or prevented by contacting step part 52*a* of detecting member 52 by the rear edge of ceiling 55*a*. The rear end of detecting member 51 is designed to just coincide with the rear end of lock piece 45 as illustrated in FIG. 10.

The operation of the second embodiment will now be described. Detecting member 51 is installed in advance at the shunting position shown in FIG. 7 against lock piece 45 of female housing F2. Female housing F2 is pushed in the direction of the arrow into male housing M2. Thereafter, detecting member 51 which is at the shunting position is pushed forwardly.

In the fitting operation of the housings, when both housings M1 and F2 are retained in the incomplete fitting state without proper hooking, downward projection 47 of lock piece 45 swings in a clockwise position while passing over hooking part 49. Therefore, detecting member 51 is obliquely pushed upwardly in the same manner as a swinging movement of lock piece 45 and the lower end of convex part 53 of detecting piece 52 contacts the rear edge of ceiling 55*a* of dome 55. As detecting piece 52 cannot be deformed by bending, pushing in on lock piece 45 of detecting member 51 is prevented and the incomplete fitting is thereby detected.

Thereafter, when detecting member 51 is further pushed in, the whole female housing F2 is pushed in by dome member 55 being pressed by detecting member 51. When female housing F2 is pushed into the proper hooking position, both housings M1 and F2 are locked by hooking downward projection 47 on the rear face of hooking part 49 while lock piece 45 returns to its original position. Along with the return of lock piece 45, detecting member 51 also swings in a similar direction. Tapered face 53*a* cooperates with ceiling 55*a* and dome 55. Therefore, when detecting member 51 is continuously pushed in, detecting member 51 is deformed by bending and pushed in under the lower side of ceiling 55*a*. When detecting member 51 advances to the predetermined position, detecting piece 52 returns and is deformed so that convex part 53 is hooked on hooking part 57. Furthermore, the stepped part of the joint side of detecting piece 52 contacts the rear edge of ceiling 55*a* and is retained in a position for preventing back and forth movement. By retaining detecting member 51 just on lock piece 45, unexpected swinging of the lock piece 45 is prevented and the housings are "double-locked".

Furthermore, when both housings M1 and F2 are properly fitted, detecting member 51 which is pushed out is pushed in and detecting piece 52 is deformed by bending and is retained in a similar manner as described above.

According to the operation of the second embodiment as described above, after female housing F2 is fitted into male housing M2, detecting member 51 is pushed in, and in the incomplete fitted state, pushing in is prevented by the contact of detecting piece 52 on dome 55, and thereby the incomplete fitting is detected. Furthermore, at this time, as the rear end of detecting member 51 protrudes from the rear end of lock piece 55, the incomplete fitting can also be detected by eyesight.

Also, when lock piece 45 is mounted on hooking part 49, the front end changes its position, and therefore detecting member 51 is pushed in along lock piece 45 and contacts dome 55 upwardly from the front end of lock piece 45. Therefore, highly reliable detection of the incomplete fitting can be achieved. Furthermore, as detecting member 51 is provided on lock piece 45, the pushing in operation also becomes easy.

After detection of the incomplete fitting, detecting member 51 is pushed in and can be locked by pushing female housing F2 to the proper position. As the pushed in detecting member 51 can be retained on the lock piece which is returned to its normal position, detecting member 51 can also be used in combination for "double-locking" the housings.

Figure 11:
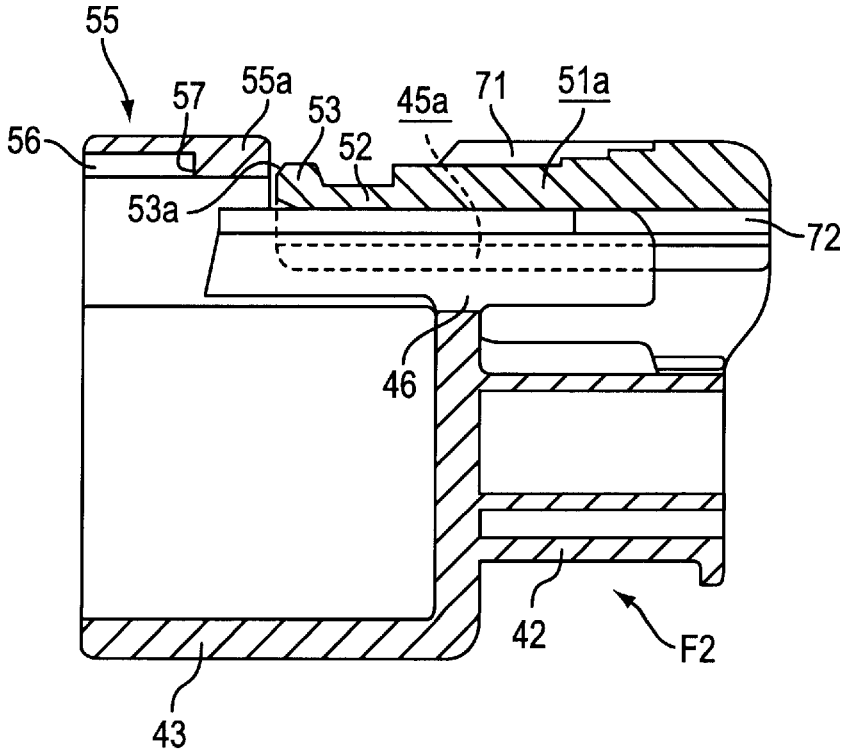
FIG. 11 is a cross sectional view of the female housing according to a third embodiment of the present invention.
Figure 12:
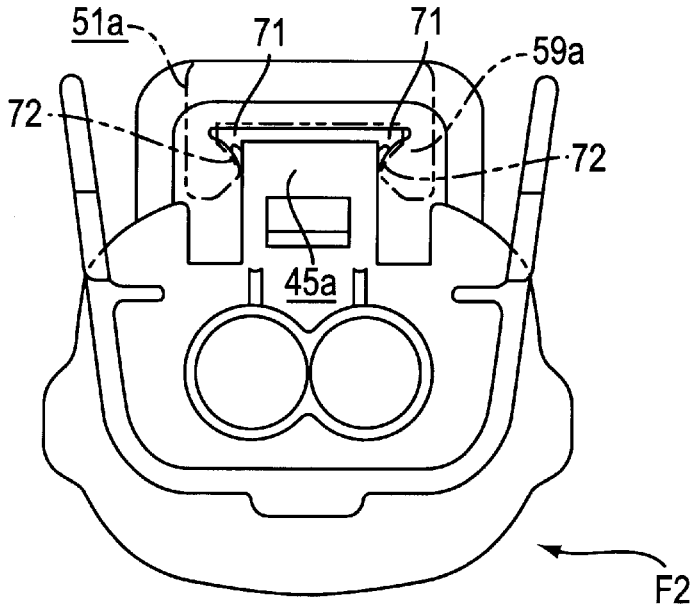
FIG. 12 is a rear view of the female housing of FIG. 11.

The third embodiment of the present invention is shown in FIGS. 11 and 12. In the third embodiment, the slide-guide structure on the lock piece and detecting member 51 is slightly changed. Rail 71 extends longitudinally in the upper face of lock piece 45 and guide grooves 72 are formed at the inner face of both legs 59*a* of detecting member 51 for receiving rail 71. Other structure and the operations are similar to the second embodiment.

Figure 13:
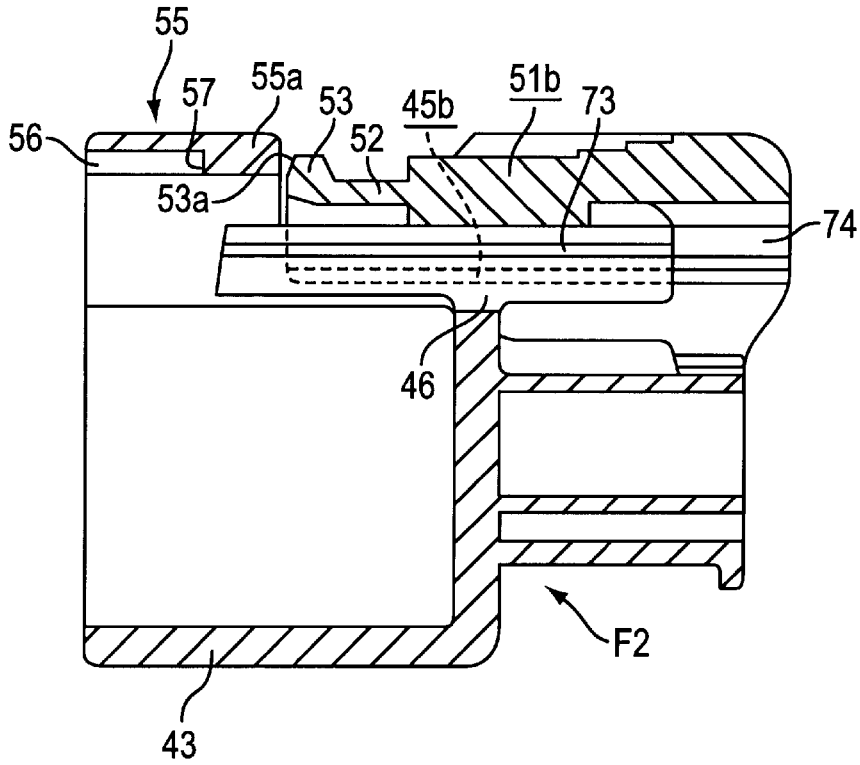
FIG. 13 is a cross sectional view of the female housing according to a fourth embodiment of the present invention.
Figure 14:
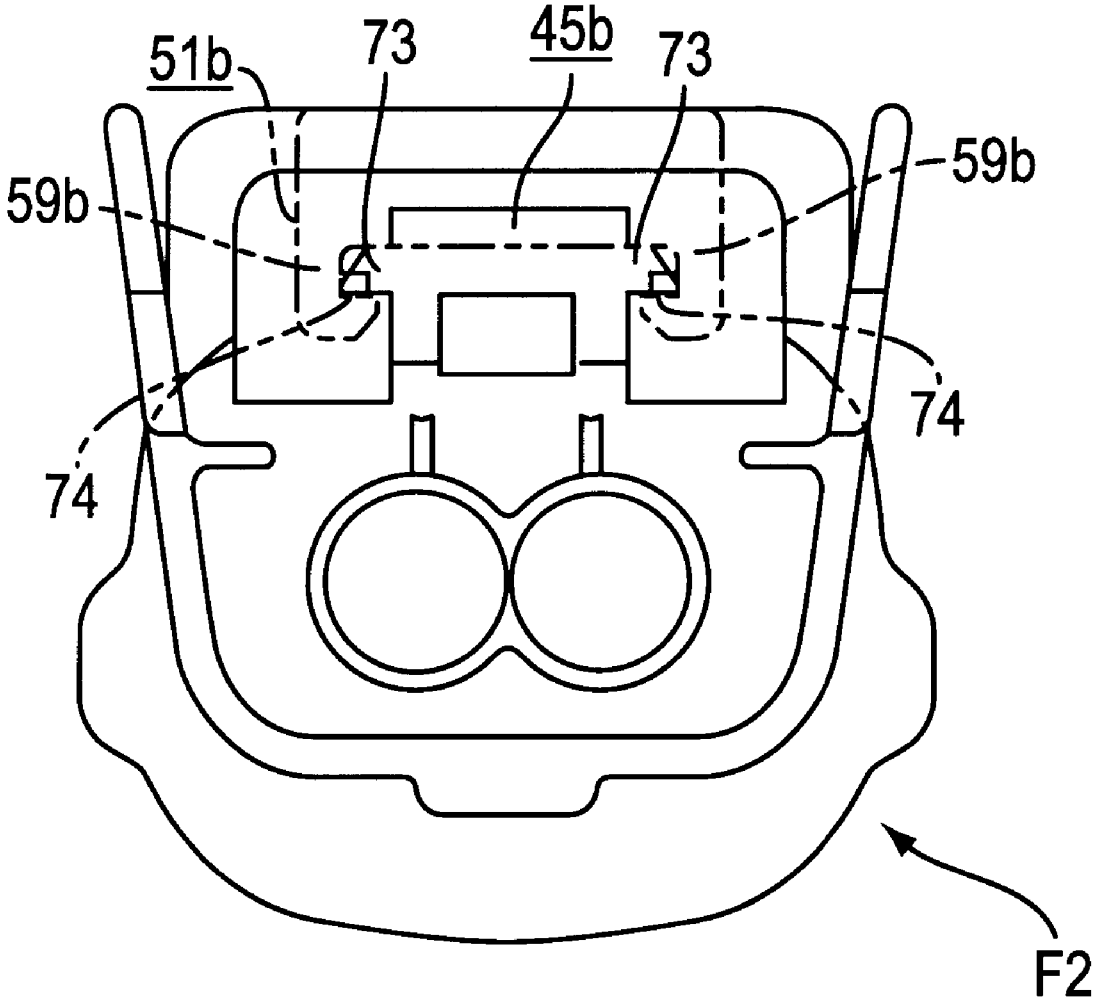
FIG. 14 is a rear view of the female housing of FIG. 13.

FIGS. 13 and 14 illustrate a fourth embodiment of the present invention. In the fourth embodiment, the slide-guide structure of lock piece 45*b* of detecting member 51*b* is slightly changed. In this embodiment, rails 73 are formed in the longitudinal direction on left and right sides of lock piece 45*b* and guide grooves 74 are formed at the inner face of both legs 59*b* of detecting member 51*b* for receiving rails 73. Other structure and operations are similar to the second embodiment.

The present invention is not limited by the mode of operation illustrated according to the above descriptions and figures. For example, the following modes of operation are included within the scope of the present invention and furthermore, various changes can be practiced within such scope in addition to the following.

In the first embodiment, the detecting member includes structure for being pushed in to the front end from the rear end of the lock piece, but it is possible to detect the incomplete fitted state when the detecting member is pushed in a transverse direction to the front side of the lock piece from the side, and this is included within the scope of the present invention.

The present invention can also be applied to conventional lock forms as well as the "momentum-lock" as illustrated and described above.

Furthermore, the present invention can also be applied to a connector with an arm-type lock piece which is installed so as to be capable of deforming by bending in the form of a cantilever, as well as the seesaw type lock piece as described above.

The present disclosure relates to subject matter contained in Japanese Application No. HEI 8-193690, filed on Jul. 23, 1996, which is expressly incorporated herein by reference in its entirety.

What is claimed is:

1. An electrical connector comprising:

first and second connector housings adapted to be moved towards each other in a fitting direction to be connected together along said fitting direction between improperly fitted positions and a properly fitted position;

a hooking part attached to one of said first and second connector housings;

a lock piece attached to the other of said first and second connector housings, said lock piece including an end portion, said end portion moving from an original position to pass over said hooking part and being adapted to return to said original position to hook said hooking part when said first and second connector housings are moved into said properly fitted position;

a detecting member which is movable along said fitting direction and which is not aligned with the position of said end portion of said lock piece, as viewed along said fitting direction when said first and second connector housings are in one of said improperly fitted positions and said end portion is not in said original position;

said detecting member including at least one upward projection, a downwardly projecting element extending from the other of said first and second connector housings, wherein said detecting member slides over said end portion of said lock piece when said first and second connector housings are in said properly fitted position, and wherein said end portion of said lock piece and said detecting member are aligned with each other, as viewed along said fitting direction, when said end portion has returned to said original position and said first and second connector housings are in said properly fitted position; and said detecting member further including a pushing member for pushing said other of said first and second connector housings into said properly fitted position from an improperly fitted position, said at least one upward projection engaging said downwardly projecting element in order to double lock said first and second connector housings together.

2. An electrical connector according to claim 1, comprising cooperating elements for keeping said detecting member at an improperly fitted position.

3. An electrical connector according to claim 1, wherein said end portion of said lock piece includes a first downward projection having a first contact face, said hooking part including a second contact face, said first contact face initially contacting said second contact face and thereafter passing over said hooking part when said first and second connector housings are moved to the properly fitted position.

4. An electrical connector according to claim 3, wherein said second contact face is inclined.

5. An electrical connector according to claim 1, wherein said lock piece comprises a lever, said lever swinging about a fulcrum on the other of said first and second connector housings.

6. An electrical connector according to claim 1, wherein said locking piece includes a groove having a pressure surface, and said detecting member contacts said pressure surface so that improper fitting can be detected.

7. An electrical connector according to claim 6, wherein said detecting member moves in a backward and forward direction along the fitting direction of the connector housings, said detecting member contacting said pressure surface and pushing the lock piece in by a predetermined force when the detecting member extends over said lock piece.

8. An electrical connector according to claim 7, comprising cooperating elements for keeping said detecting member at an improperly fitted position.

* * * * *